US009806450B2

(12) United States Patent
Liao

(10) Patent No.: US 9,806,450 B2
(45) Date of Patent: Oct. 31, 2017

(54) ELECTRICAL CONNECTOR WITH ZERO-INSERTION-FORCE FORMINALS

(71) Applicant: FOXCONN INTERCONNECT TECHNOLOGY LIMITED, Grand Cayman (KY)

(72) Inventor: Fang-Jwu Liao, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/460,268

(22) Filed: Mar. 16, 2017

(65) Prior Publication Data

US 2017/0271801 A1 Sep. 21, 2017

(30) Foreign Application Priority Data

Mar. 17, 2016 (CN) ..... 2016 2 0204640 U

(51) Int. Cl.

| | |
|---|---|
| ***H01R 13/627*** | (2006.01) |
| ***H01R 13/193*** | (2006.01) |
| ***H01R 13/11*** | (2006.01) |
| ***H01R 13/631*** | (2006.01) |
| ***H01R 13/415*** | (2006.01) |
| ***H01R 24/86*** | (2011.01) |
| *H01R 107/00* | (2006.01) |

(52) U.S. Cl.

CPC ..... *H01R 13/193* (2013.01); *H01R 13/113* (2013.01); *H01R 13/415* (2013.01); *H01R 13/631* (2013.01); *H01R 24/86* (2013.01); *H01R 2107/00* (2013.01)

(58) Field of Classification Search

CPC ..... H01R 12/82; H01R 13/193
USPC ..... 439/342, 259, 376
See application file for complete search history.

(56) References Cited

U.S. PATENT DOCUMENTS

| | | | | |
|---|---|---|---|---|
| 6,450,826 | B1 * | 9/2002 | Howell | H01R 12/57 439/342 |
| 7,896,680 | B2 * | 3/2011 | Szu | H01R 13/193 439/342 |
| 8,177,574 | B2 * | 5/2012 | Ju | H01R 24/00 439/342 |
| 8,221,172 | B2 * | 7/2012 | Ju | H01R 13/111 439/342 |
| 8,401,557 | B2 * | 3/2013 | Negishi | H04W 36/32 455/436 |

(Continued)

FOREIGN PATENT DOCUMENTS

CN 201041915 Y 3/2008

*Primary Examiner* — Phuong Dinh
(74) *Attorney, Agent, or Firm* — Wei Te Chung; Ming Chieh Chang

(57) ABSTRACT

An electrical connector assembly includes a first electrical connector and a second electrical connector mounted on the first electrical connector moveably. The first electrical connector includes an insulative housing, a number of first terminals and a cover mounted on the insulative housing. Each of the first terminals includes a pair of elastic mating portions having two guiding portions extending therefrom. The second electrical connector includes an insulative base and a number of second terminals. When the second electrical connector is connected with the first electrical connector, the second terminals are inserted into the first terminals in a zero-insertion-force manner.

6 Claims, 10 Drawing Sheets

(56) References Cited

U.S. PATENT DOCUMENTS

| | | | | |
|---|---|---|---|---|
| 8,430,682 | B2 * | 4/2013 | Liao | H01R 12/57 439/342 |
| 9,088,084 | B2 * | 7/2015 | Liao | H01R 13/41 |
| 2003/0068916 | A1 * | 4/2003 | Ju | H05K 7/1084 439/342 |
| 2004/0127085 | A1 * | 7/2004 | Chen | H01R 12/57 439/342 |
| 2005/0245121 | A1 * | 11/2005 | Lin | H01R 12/57 439/342 |
| 2006/0258200 | A1 * | 11/2006 | Hao | H01R 12/57 439/342 |

* cited by examiner

ELECTRICAL CONNECTOR WITH ZERO-INSERTION-FORCE FORMINALS

BACKGROUND OF THE INVENTION

1. Field of the Invention

The present invention relates to an electrical connector, and particularly to a second electrical connector inserted in the first electrical connector in a zero-insertion-force (ZIF) manner.

2. Description of Related Art

Chinese Patent No. CN201041915 discloses an electrical connector having an insulative housing, a cover and a plurality of first and second terminals. The second terminals go through the cover and are inserted into the first electrical connector to electrically connect with the first terminals. However, as the second terminals are inserted into the first terminals with resistance, the first terminals could be damaged easily.

Therefore, an improved electrical connector which can avoid damaging the first terminals is desired.

SUMMARY OF THE INVENTION

Accordingly, an object of the present invention is to provide an electrical connector assembly including a first electrical connector and a second connector. The first electrical connector comprises an insulative housing with a plurality of terminal cavities, a plurality of first terminals retained in the corresponding terminal cavities and a cover mounted on a top surface of the insulative housing. Each of the first terminals comprises a pair of elastic mating portions having two guiding portions extending therefrom and a soldering portion extending from a top surface to a bottom surface of the insulative housing. The cover comprises a plurality of holes going through from a top surface of the cover to a bottom surface of the cover. The second electrical connector comprises an insulative base and a plurality of second terminals retained in the insulative base. Each of the second terminals comprises a pin extending out of a bottom surface of the insulative base and a connecting portion extending out of a top surface of the insulative base. The pins of the second electrical connector are inserted into the guiding portions of the first electrical connector in a zero-insertion-force manner, when the second electrical connector is mounted on the first electrical connector. The cover is moved to drive the pins of the second electrical connector to connect with the elastic mating portions to achieve an electrical connection therebetween Other objects, advantages and novel features of the invention will become more apparent from the following detailed description when taken in conjunction with the accompanying drawings.

DETAILED DESCRIPTION OF THE PREFERRED EMBODIMENT

Figure 1:
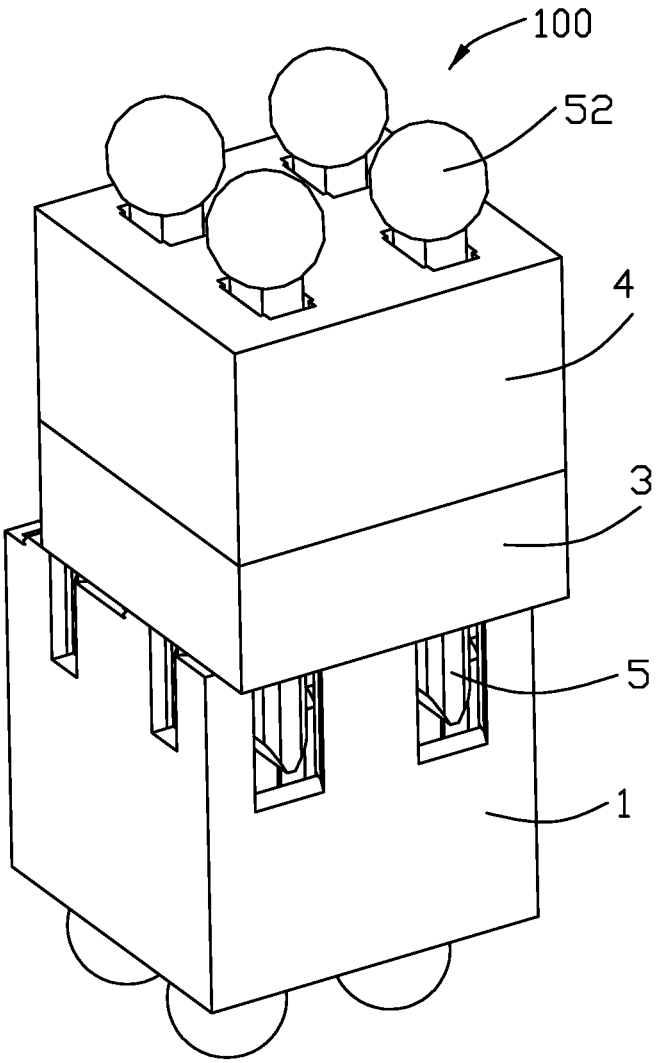
FIG. 1 is a perspective view of an electrical connector assembly according to a preferred embodiment of the invention.
Figure 2:
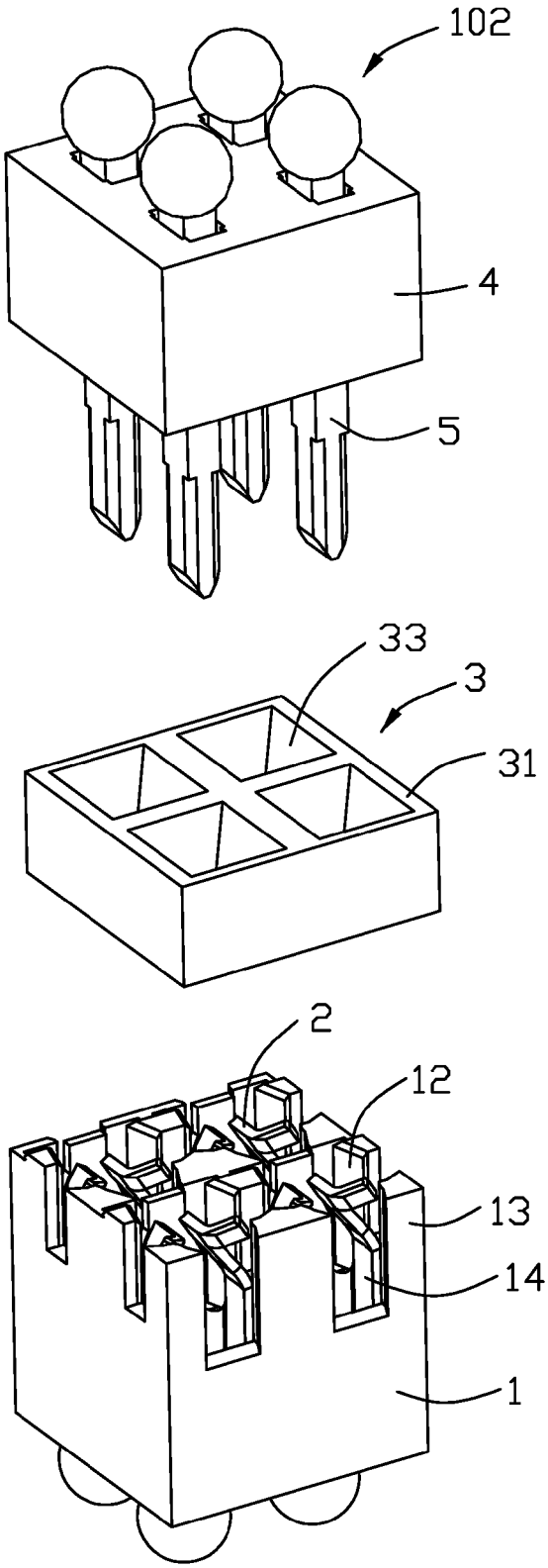
FIG. 2 is a downwardly exploded perspective view of the electrical connector assembly of FIG. 1.
Figure 2A:
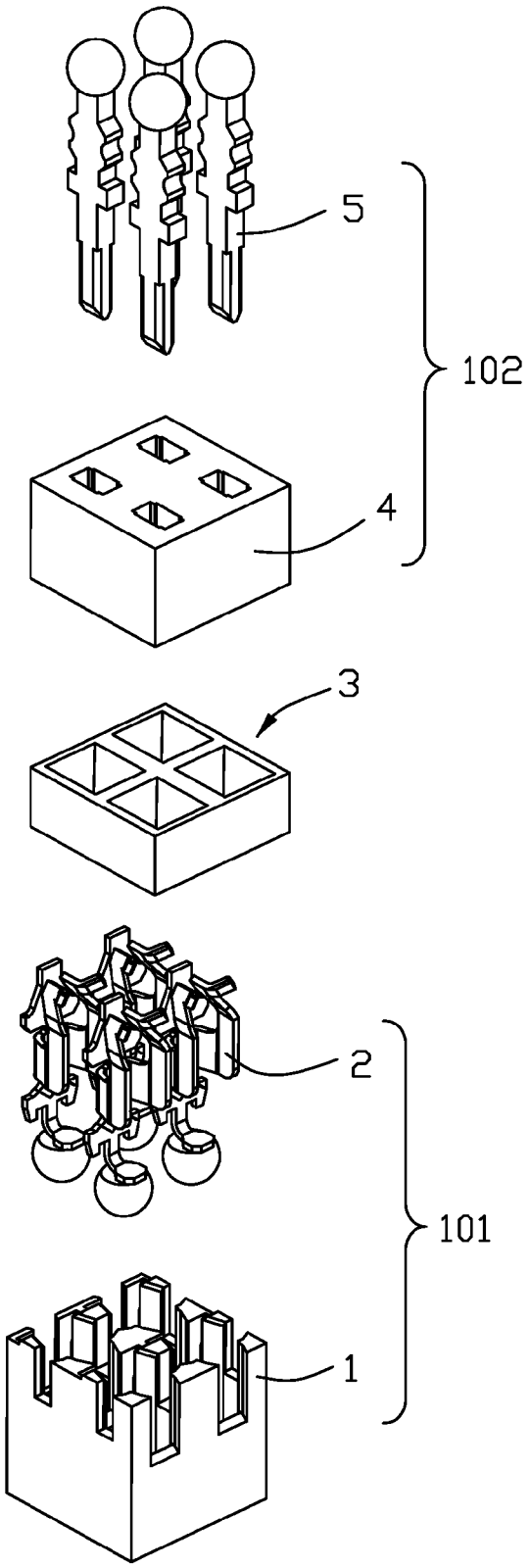
FIG. 2(A) is a further downwardly exploded perspective view of the electrical connector assembly of FIG. 1.

Reference will now be made in detail to the preferred embodiment of the present invention.

Referring to FIGS. 1-8(B), an electrical connector assembly 100 includes a second electrical connector 102 mounted on a first electrical connector 101 in a zero-insertion-force (ZIF) manner. The first electrical connector 101 includes an insulative housing 1, a plurality of first terminals 2 retained in the insulative housing 1 and a cover 3 mounted on the insulative housing 1. The second electrical connector 102 includes an insulative base 4 and a plurality of second terminals 5 retained therein. In this embodiment, the first connector 101 and the second connector 102 are respectively soldered upon the corresponding rigid/flexible printed circuit boards.

The insulative housing 1 includes a lot of first terminal cavities 11 each formed/surrounded by the corresponding partition walls (not labeled) and going through from a top surface to a bottom surface of the insulative housing 1 and four side walls 12 surrounding around anyone of the first terminal cavities 11. Each of the side walls 12 has a groove 14 going through a top surface and a side surface 13 of the insulative housing 1.

The first terminals 2 are retained in the first terminal cavities 11, respectively. Each of the first terminals 2 includes a first main portion 21, a soldering portion 22 extending from the first main portion 21 to the bottom surface of the insulative housing 1, a pair of elastic arms 23 extending from the first main portion 21, and a pair of elastic mating portions or contacting sections 24 respectively extending form the pair of the elastic arms 23 to the top surface of the insulative housing 1. The soldering portions 22 are provided with a lot of solder balls soldered at the bottom of the first terminals 2. Each of the elastic mating portion 24 has a guiding portion 25 extending transversely thereof.

The cover 3 optionally associated with the housing 1, includes a lot of holes going through the cover 3 from a top surface 31 to a bottom surface 32 thereof. Each of the holes aligns to one of the first terminal cavities 11 in a vertical direction perpendicular to the transverse direction. Each of the holes has an upper portion 33 and a lower portion 34. The upper portion 33 is an inverted trapezoidal groove, and the walls of the upper portion 33 are inclined planes. The walls of the lower portion 34 are vertical surfaces perpendicular to the top surface 31. The smallest perimeter of the upper portion 33 is as the same as the perimeter of the lower portion 34.

The insulative base 4 includes a lot of second terminal cavities 41 aligning to the corresponding holes of the cover in the vertical direction. The second terminals 5 are retained in the second terminal cavities 41, respectively. The insulative base 4 has a bottom surface contacting with the top surface 31 of the cover 3.

Figure 3:
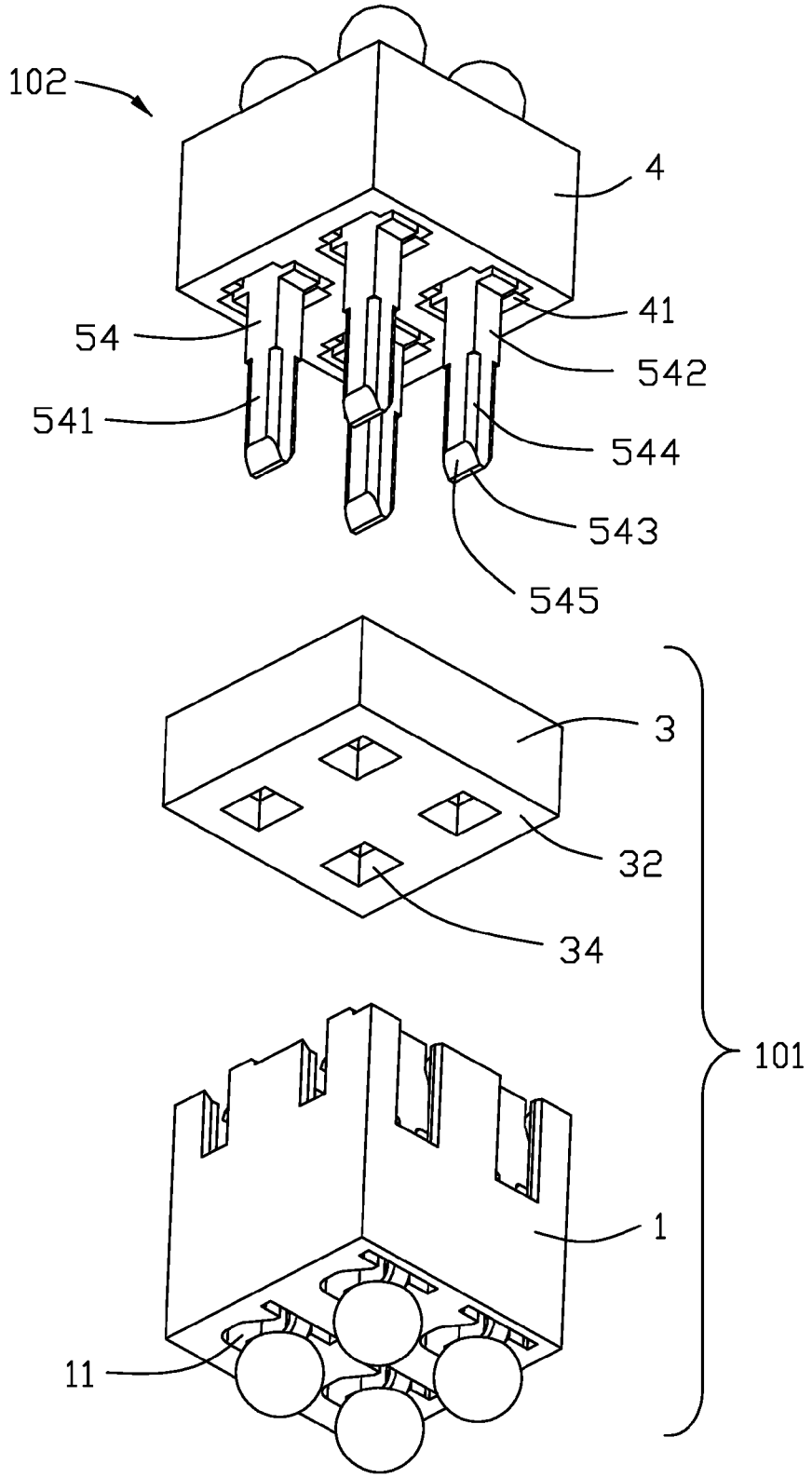
FIG. 3 is an upwardly exploded perspective view of the electrical connector assembly of FIG. 1.
Figure 4:
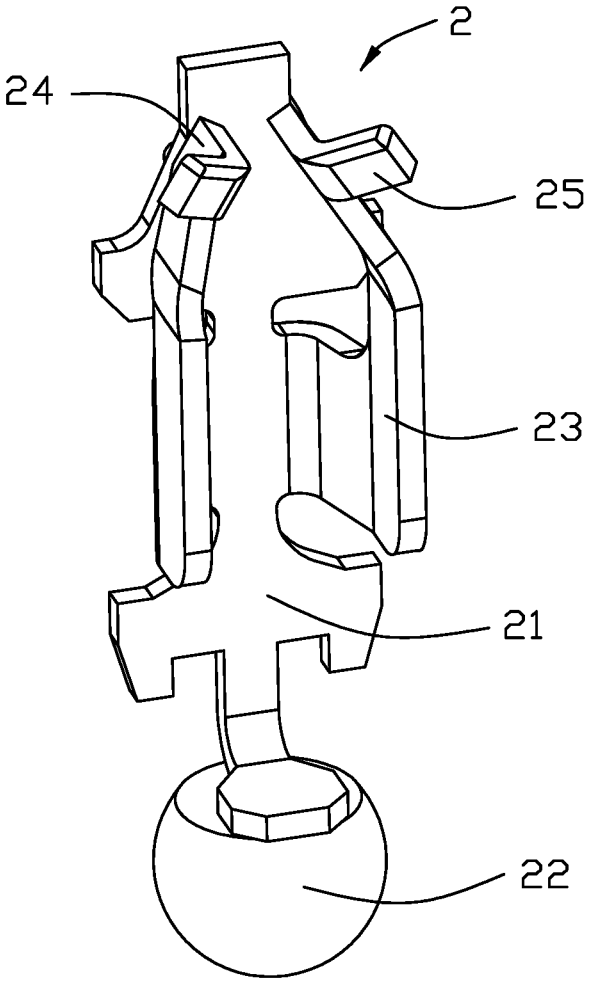
FIG. 4 is a perspective view of a first terminal of the electrical connector assembly of FIG. 2.
Figure 5:
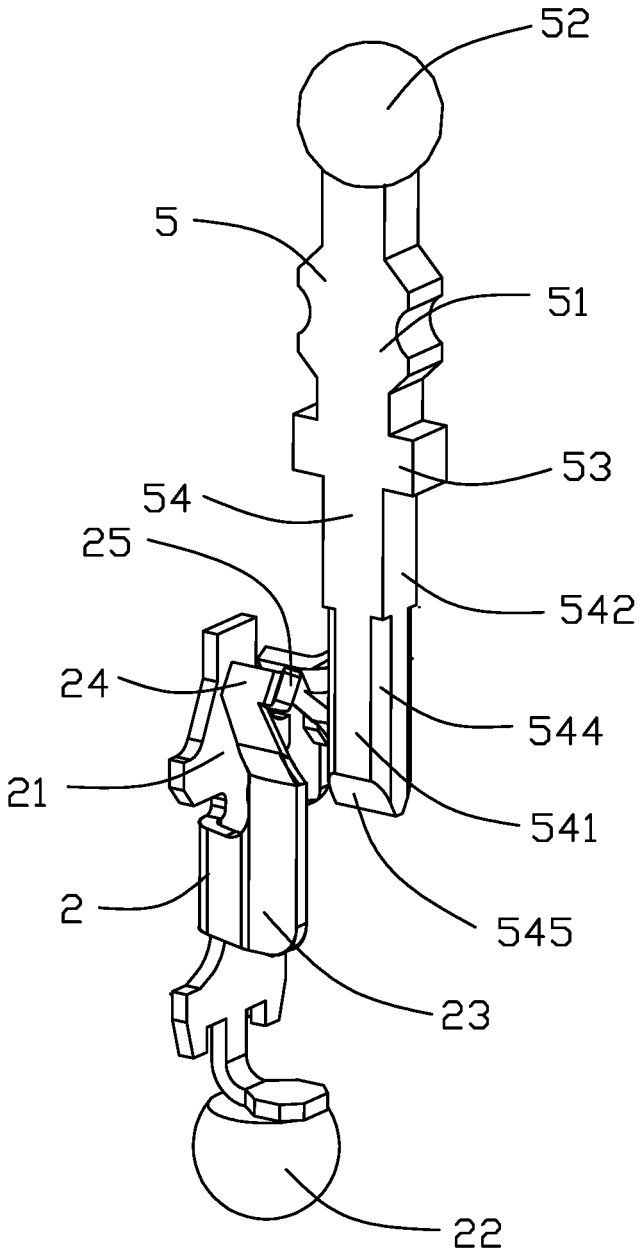
FIG. 5 is a perspective view of a first terminal and a second terminal of the electrical connector assembly of FIG. 2.

Referring to FIG. 3 and FIG. 5, each of the second terminals 5 includes a second main portion 51, a connecting portion 52 extending upwardly from the second main portion 51 and out of the top surface of the insulative base 4, a retaining portion 53 extending from the second main portion 51, and a pin or contacting section 54 extending downwardly from the second main portion 51 and out of a bottom/mating surface of the insulative base 4. Both of the second main portion 51 and the retaining portion 53 are retained in the second terminal cavities 41. The connecting portions 52 are provided with soldering balls soldered on the second terminals. Each of the pins 54 includes two opposite mating faces 541 connecting with the elastic mating portion 24, two side-faces 542 connecting between the mating faces 541, and a lower face 543 connecting with the mating faces 541 and the side-faces 542. Each of the pins 54 also has four connecting faces 544 located between the mating faces 541 and the side-faces 542 and connecting therebetween. Each of the pins 54 includes two lead-in faces 545 located between the mating faces 541 and the lower face 543. The connecting faces 544 are cut off by the lead-in faces 545 at the bottom of the pins 54. The width of the mating face 541 is larger than the width of the side-face 542. The pins 54 can be inserted into the first terminals 2 in a zero-insertion-force through the connecting faces 544 and the lead-in faces 545.

Figure 6:
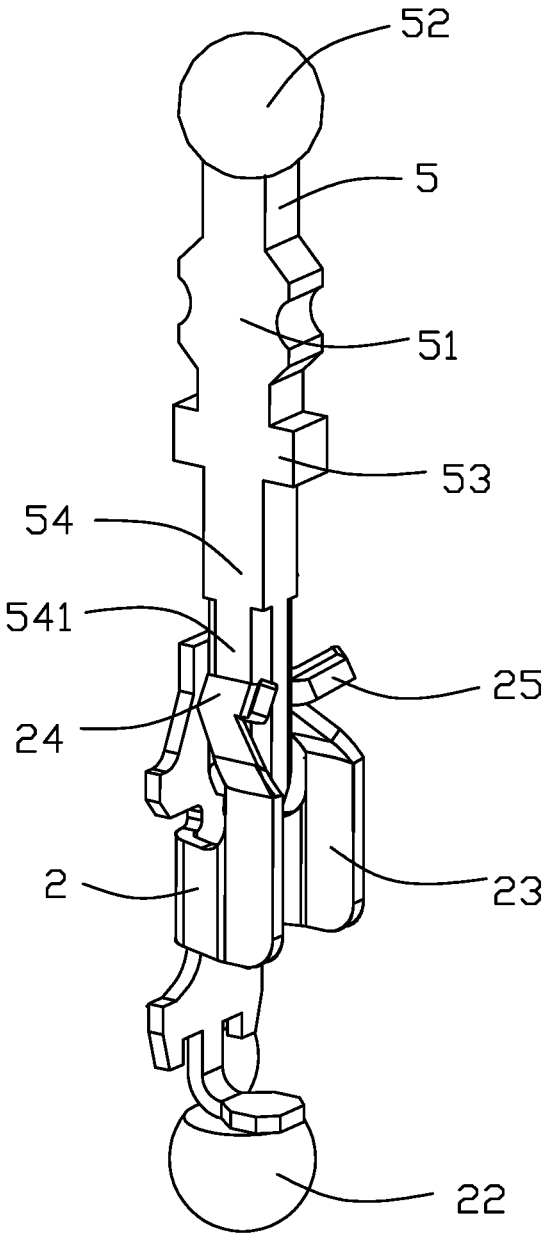
FIG. 6 is a perspective view of the second terminal inserted in the first terminal of FIG. 5.
Figure 7:
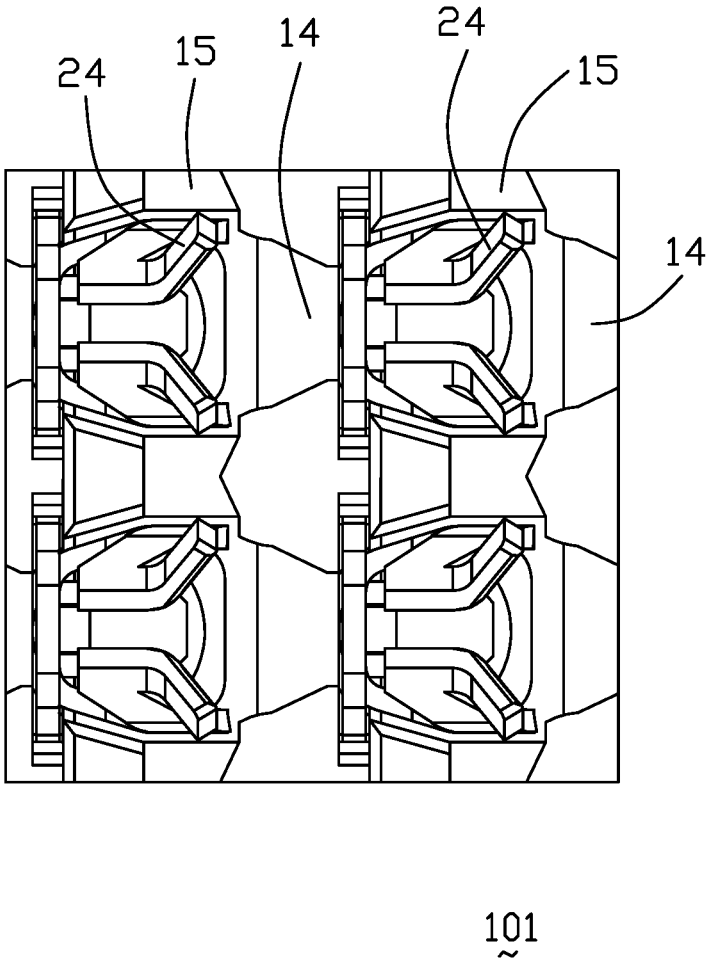
FIG. 7 is a top view of the first electrical connector of FIG. 1 to show how the first terminal is located in the corresponding terminal cavity.
Figure 8A:
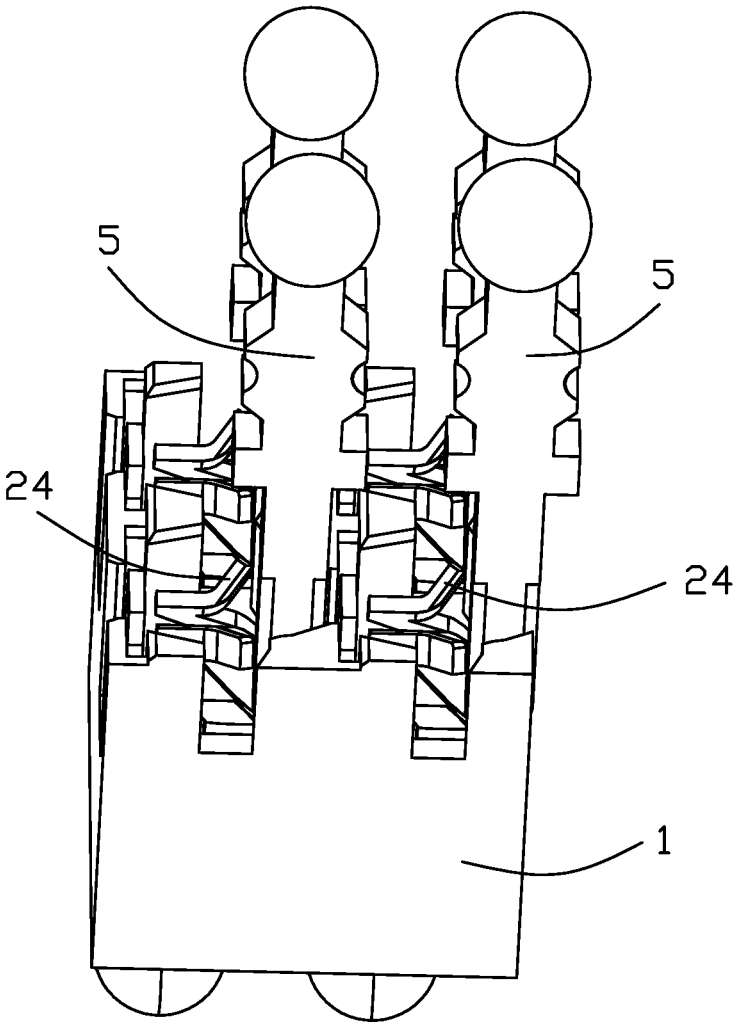
FIG. 8(A) is a perspective view of the second terminal spaced from the first connector of FIG. 1.
Figure 8B:
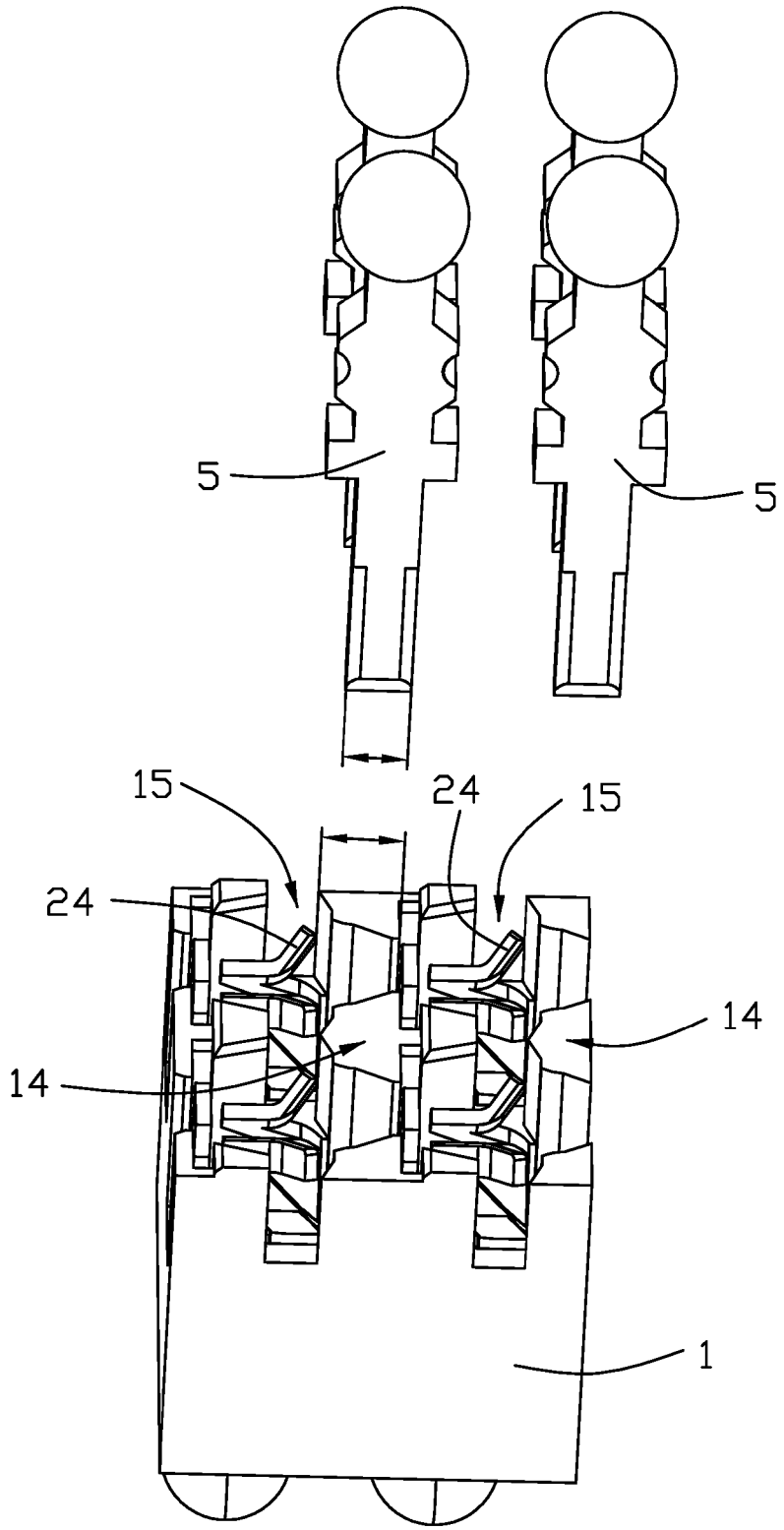
FIG. 8(B) is a perspective view of the second terminal inserted into the first connector of FIG. 1.

Referring to FIG. 5 and FIG. 6, when the second electrical connector 102 mounted on the first electrical connector 101, the pins 54 of the second electrical connector 102 are inserted, along the vertical direction, into the guiding portions 25 of the first electrical connector 101 in a zero-insertion-force (ZIF) manner. The pins 54 of the second electrical connector 102 do not touch with the elastic mating portion 24. Then, the cover 3 is moved along a first transverse direction perpendicular to the vertical direction, to drive the pins 54 of the second electrical connector 102 across the grooves 14 into the elastic mating portions 24. The pins 54 of the second electrical connector 102 electrically contact with the elastic mating portion 24 to achieve an electrical connection between the first terminals 2 and the second terminals 5. It is noted that during mating the elastic mating portion 24 is deflected in a second transverse direction perpendicular to both the vertical direction and the first transverse direction. In this embodiment, the groove 14 formed in and extending through the corresponding partition wall of the housing 1 in the first transverse direction, provides the space in which the corresponding pin 54 is received in the ZIF manner at the first stage during mating, thus allowing a fine pitch/high density arrangement of the corresponding first terminals 2 as well as the second terminals 5. Furthermore, the pin 54 is essentially disposed in the space formed among the pair of mating portions 24 and the corresponding main portion 21 at the second stage during mating. It is noted that in this embodiment, the groove 15 is further formed in the neighboring/lateral partition so as to receive the diverged tip/front section of the elastic mating portion 24 when the elastic mating portion 24 is outwardly/laterally deflected, in the second transverse direction, by the corresponding inserted second terminal 5 at the second stage during mating.

The second terminals 5 are inserted into the first terminals 2 in a zero-insertion-force (ZIF) manner at the first stage during mating. It is easy for using because of moving the cover 3 to drive the pins 54 electrically connecting with the elastic mating portion 24, and can avoid damaging the first terminals 2. The contacting area between the pins 54 and the elastic mating portion 24 should be enlarged due to the square mating surfaces 541, instead of the round mating surface of the conventional pin, at the second stage during mating, and it could make the first terminals 2 connect with the second terminals 5 stably. It is also noted that the cross-section of the second contacting section 54 defines a rectangle with a long side and a short side thereof wherein the long side extends in said first transverse direction while the short side extends in the second transverse direction.

However, the disclosure is illustrative only, changes may be made in detail, especially in matter of shape, size, and arrangement of sections within the principles of the invention.

What is claimed is:

1. An electrical connector assembly comprising:

a first electrical connector, comprising:

an insulative housing with a plurality of terminal cavities;

a plurality of first terminals retained in the corresponding terminal cavities, each of the first terminals comprising a pair of elastic mating portions with two guiding portions extending therefrom and a soldering portion extending to a bottom surface of the insulative housing; and a cover mounted on a top surface of the insulative housing and comprising a plurality of holes going through from a top surface of the cover to a bottom surface of the cover;

a second electrical connector, comprising:

an insulative base; and a plurality of second terminals retained in the insulative base, each of the second terminals comprising a pin extending out of a bottom surface of the insulative base and an connecting portion extending out of a top surface of the insulative base; wherein the pins of the second electrical connector are inserted into the guiding portions of the first electrical connector in a zero-insertion-force manner, when the second electrical connector is mounted on the first electrical connector, and the cover is moved to drive the pins of the second electrical connector to connect with the elastic mating portions to achieve an electrical connection therebetween, wherein each of the pins comprises two opposite rectangular mating faces electrically connecting with the elastic mating portions and two side-faces connecting therebetween, and the width of the mating face is larger than the width of the side-face wherein each of the pins comprises four connecting faces located between the mating faces and the side-faces, wherein each of the pins comprises a lower face connecting with the mating faces and the side-faces, and two lead-in faces located between the mating faces and the lower face, wherein the connecting faces are cut off by the lead-in faces at the bottom of the pins, wherein the insulative housing comprises a plurality of side walls surrounding around the terminal cavities, and each of the side walls comprises a groove going through both of a top surface and a side surface of the insulative housing, wherein the connecting portions are provided with soldering balls soldered on the second terminals.

2. An electrical connector assembly comprising;

a first electrical connector and a second electrical connector adapted to be mated with each other, said first electrical connector including a first insulative housing with a plurality of terminal cavities extending therethrough in a vertical direction;

a plurality of first terminals disposed in the corresponding terminal cavities, respectively, each of said first terminals having a first contacting section located in the corresponding terminal cavities;

an insulative cover intimately positioned upon a top face of the first insulative housing and moveable in a first transverse direction perpendicular to the vertical direction, a plurality of through holes extending through the insulative cover;

said second electrical connector including:

a second insulative housing;

a plurality of second terminal disposed in the second insulative housing, each of said second terminals having a second contacting section extending out of a mating face of the second insulative housing; wherein during mating, each of the second contacting sections initially snugly extends through the corresponding through holes and into the corresponding terminal cavity in the vertical direction in a zero-insertion-force (ZIF) manner at a first stage, and is successively moved in the first transverse direction by the insulative cover to connect to the corresponding first terminal in the corresponding terminal cavity at a second stage, wherein each of said first terminals and said second terminals is equipped with a solder ball, wherein a cross-section of the second contacting section defines a first rectangle, and a cross-section of the through hole defines a second rectangle in compliance with the first rectangle so as to have the through hole snugly receive the second contacting section therein and having the cover move the second contacting section in the first transverse direction synchronically, wherein the first rectangle defines a long side extending along the first transverse direction, and a short side extending along the second transverse direction, wherein each of said terminal cavity is formed and surrounded by corresponding partition walls of the housing, and is associated with a groove which is formed in one of said surrounding partition walls and communicates with the terminal cavity in the first transverse direction so as to allow the corresponding second contacting section is initially inserted into the groove in the vertical direction without interference with the corresponding partition wall in said ZIF manner, wherein each of said first terminals includes a planar main portion intimately in alignment with the groove of a neighboring terminal cavity.

3. The electrical connector assembly as claimed in claim 2, wherein said groove extends through the corresponding partition wall in the first transverse direction.

4. The electrical connector assembly claimed in claim 2, wherein each of said first terminal includes at least resilient contacting section which is deflectable at the second stage during mating in a second transverse direction perpendicular to both said vertical direction and said first transverse direction.

5. The electrical connector assembly as claimed in claim 3, wherein each of the terminal cavities is further associated with a groove which is formed in one of partition walls surrounding said one of the terminal cavities and communicates with the said one of the terminal cavities in the second transverse direction.

6. The electrical connector assembly as claimed in claim 5, wherein the first contacting section of each of said first terminals includes a diverged front/tip end section adapted to be received in the corresponding groove at the second stage during mating.

* * * * *